US006083059A

United States Patent [19]

Kuan

[11] Patent Number: 6,083,059

[45] Date of Patent: Jul. 4, 2000

[54] STRUCTURE OF A TERMINAL

[75] Inventor: Chi-Te Kuan, Tao-Yuan Hsien, Taiwan

[73] Assignee: Ant Precision Industry Co., Ltd., Taipei, Taiwan

[21] Appl. No.: 09/321,962

[22] Filed: May 28, 1999

[51] Int. Cl.[7] ..... H01R 4/48

[52] U.S. Cl. ..... 439/862; 439/700; 439/482

[58] Field of Search ..... 439/289, 219–220, 439/482, 824, 700, 816

[56] References Cited

U.S. PATENT DOCUMENTS

| | | | |
|---|---|---|---|
| 4,773,877 | 9/1988 | Kruger et al. | 439/700 |
| 5,540,599 | 7/1996 | Bishop | 439/700 |
| 5,667,410 | 9/1997 | Johnston | 439/700 |
| 5,967,856 | 10/1999 | Meller | 439/700 |

*Primary Examiner*—Paula Bradley
*Assistant Examiner*—Briggitte R. Hammond

[57] ABSTRACT

An improved structure of a terminal includes a horseshoe-shaped contact portion with a smooth contact surface. The terminal is formed on a substrate by punching. It has a fixing portion on which a plurality of tenons are formed so as to be fixed in the housing of a connector. The lower end of the terminal is a pin portion bent to be orthogonal to the flat surface of the fixing portion. A raster spring with an upper protruded part is formed above the fixing portion. A horseshoe-shaped contact portion is connected to the upper protruded part of the raster spring. The contact portion has a smooth surface for providing high quality and low noise electrical contact.

1 Claim, 4 Drawing Sheets

STRUCTURE OF A TERMINAL

FIELD OF THE INVENTION

The present invention relates to an improved structure of a terminal, and especially to a terminal structure having a contact portion with a smooth contact surface for reducing noise as well as costs of production and molding.

BACKGROUND OF THE INVENTION

Connectors serve to electrically connect two devices. A plurality of terminals are usually installed in a connector. FIG. 1 shows a conventional terminal 10 which is punched from a substrate. The pin 11 is bent with a proper angle and further bent longitudinally to retain a tenon 12 in a vertical state. The upper end of the tenon 12 is bent downwards with a proper length and then bent reversely so as to form an elastic portion 13. Next, it is further bent to form a circular contact surface 14. The elastic portion 13 serves to allow the connector 40 (as shown in FIG. 4) to be assembled to a device (such as a mobile phone). The terminal 10 may be reduced inwards for providing an elastic force so that the contact surface 14 may tightly resist against the contact surface (not shown) of the device. Then the contact surface 14 is plated and curled to form a material strip for performing the automatic assembly of the terminal and the connector 40. When such a terminal 10 is wound as a material strip, the structure is easily deformed. Thus, the failure rate in production is very high. As a result, this terminal 10 is not used by most manufactures, while an alternative type of terminal shown in FIG. 2 is adopted.

As illustrated in FIG. 2, the structure of the terminal is different from that of FIG. 1. In the alternative design, the terminal is formed by punching. The terminal 20 is formed with a fixing portion 21 on which a plurality of tenons 22 are punched for fixing the connector within a housing. The lower end thereof is installed with a pin 23. After punching, the pin 23 is vertical to the fixing portion 21. The upper end of the fixing portion 21 is punched to form a raster spring 24. The upper end of the raster spring 24 is punched with a contact portion 25. When this terminal 20 is wound to form a material strip, the failure rate is greatly decreased and the production cost is reduced. However, since the contact portion 25 is punched, it has a contact surface which is fairly rough when the connector is connected to a device, the terminal is easily displaced due to vibration and some noise is induced. The noise will affect the quality of communication between the connected devices. Therefore, although such a design is helpful in production, it dramatically degrades the quality of the connector 40. Accordingly, the prior art terminals 10 and 20 are not ideal. There is a strong demand for an improved terminal that can provide good connection and is easy to manufacture.

SUMMARY OF THE INVENTION

The present invention has been made in accordance with the demand of a high quality and durable terminal. The novel terminal structure of this invention has a smooth contact area on its contact portion. The smooth contact area reduces the noise that may be generated due to improper contact caused by vibration. The terminal also has a flat shape raster spring which can be manufactured with high yield.

Therefore, the primary object of the present invention is to provide an improved structure of a terminal formed on a substrate by punching, wherein the terminal has a fixing portion having a plurality of tenons punched thereon for being fixed in the housing of a connector. The lower end of the terminal has a pin which serves as a welding point.

The pin portion is formed by punching the substrate and it is bent so as to be orthogonal to the surface of the fixing portion that has been made with a flat shape. A raster spring is formed above the fixing portion and a contact portion is formed above the raster spring. The raster spring has an upper protruded portion connected to the contact portion that comprises a smooth surface for providing high quality and low noise electrical contact.

The various objects and advantages of the present invention will be more readily understood from the following detailed description when read in conjunction with the appended drawings.

DETAILED DESCRIPTION OF THE PREFERRED EMBODIMENTS

Figure 3:
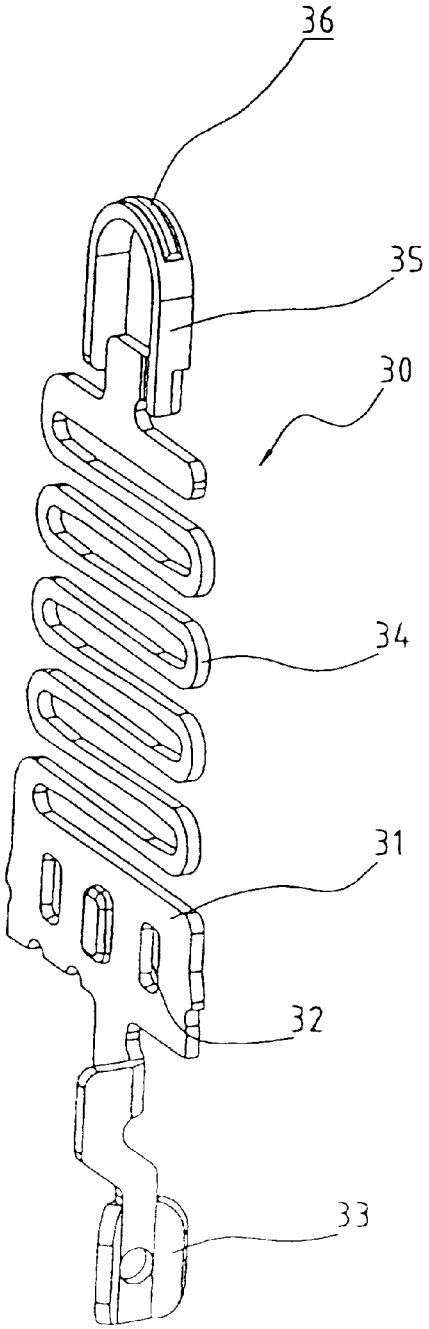
FIG. 3 is a perspective view of the terminal according to the present invention.
Figure 4:
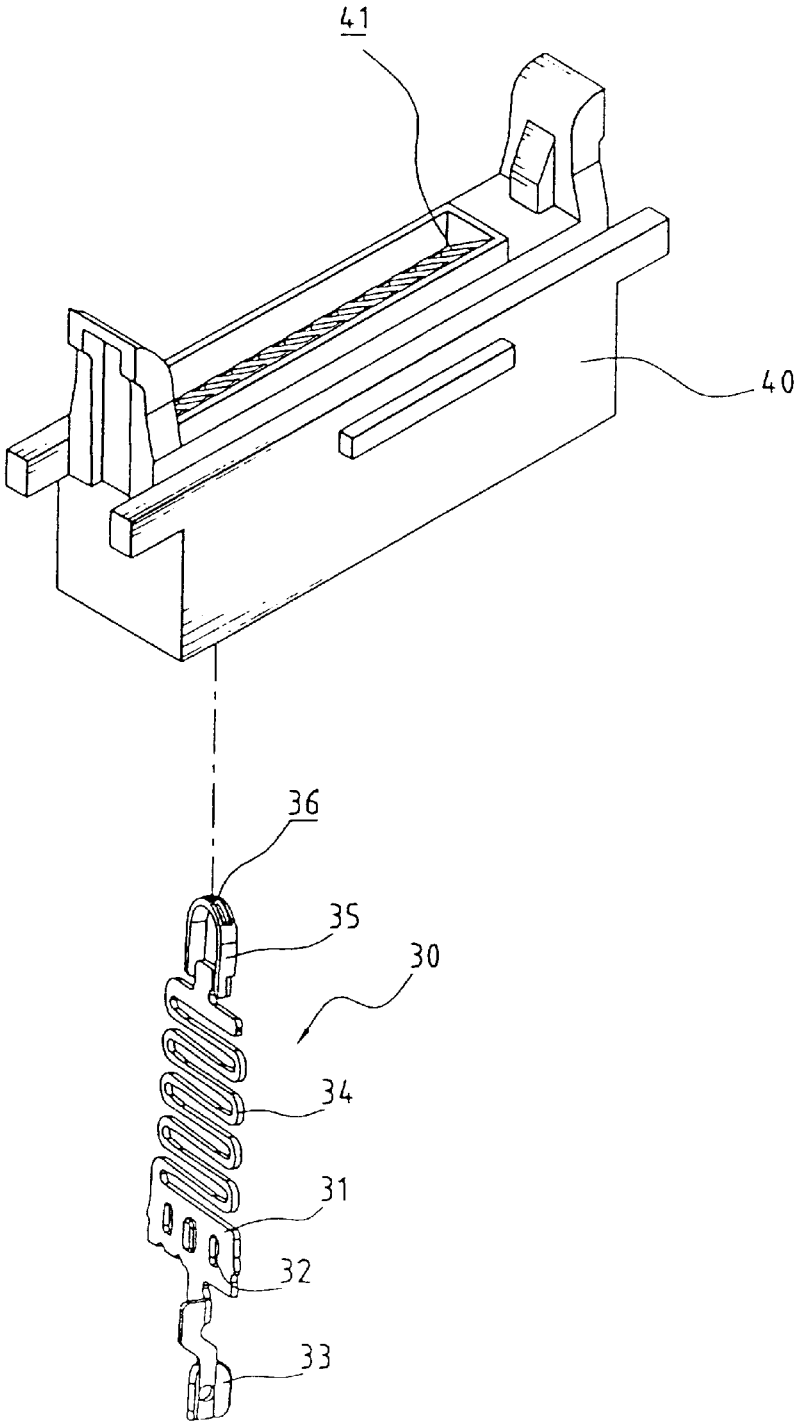
FIG. 4 shows the terminal and the connector housing of the present invention.

As shown in FIG. 3, the perspective view of the terminal of the present invention is illustrated. The terminal 30 is formed on a substrate by punching. The terminal 30 has a fixing portion, and a plurality of tenons 32 punched thereon for being fixed in the housing of a connector 40 (as shown in FIG. 4). The lower end thereof is a pin 33 which serves as a welding point. After punching, the pin portion is bent so as to be orthogonal to the flat surface of the fixing portion 31. The upper end of the fixing portion 31 is punched with a raster spring 34 above which a contact portion 35 is punched. After punching, the contact portion 35 is initially an elongated flat body extended upward above the raster spring 34. As shown in FIG. 3, there is a protruded portion on the upper part of the raster spring 34. The lower end of the elongated flat body is connected to the protruded portion from one side. The lower end is then bent 90 degrees with respect to the protruded portion at the connected area in such a way that the flat body becomes orthogonal to the flat surface of the raster spring. The upper end of the flat body is then bent downward towards the protruded portion to form a horseshoe-shaped contact portion 35. A smooth surface 36 on the outer surface of the contact portion 35 serves as a contact point for high quality electrical connection.

Figure 1:
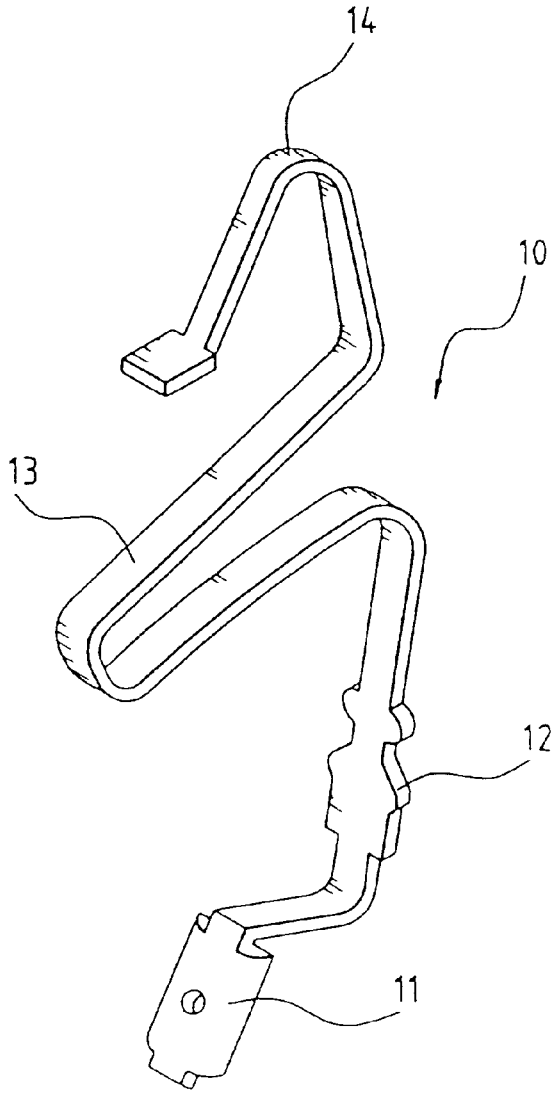
FIG. 1 PRIOR ART
FIG. 1 shows a terminal structure in the prior art.
Figure 2:
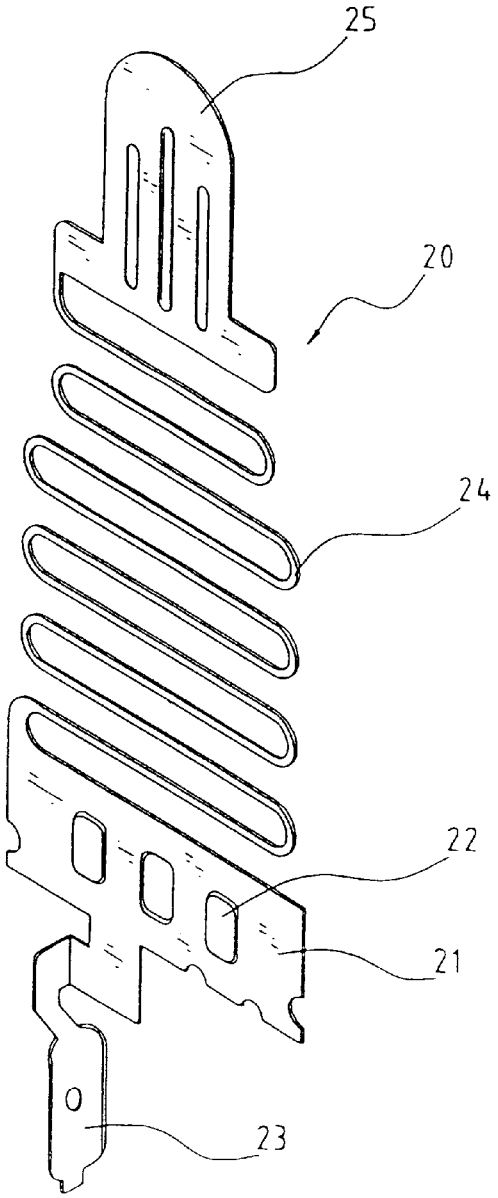
FIG. 2 PRIOR ART
FIG. 2 shows another terminal structure of the prior art.

According to the invention, the raster spring 34 of the terminal is formed with a flat shape. It can be manufactured easily without deformation. Thus the terminal has the advantage of low failure rate in manufacturing as the terminal 20 shown in FIG. 2. Moreover, as shown in FIG. 4, the connector 40 is installed with a plurality of slots 41. A plurality of terminals 30 are assembled to the slots 41. When the connector 40 is assembled to a device (such as a mobile phone, etc), the terminal 30 will be extruded so that the raster spring 34 will be compressed. An elastic force is induced so that the smooth surface 36 of the contact portion 35 will resist against the device. Therefore, the problem that the contact portion 25 of the terminal 20 shown in FIG. 2 is easily displaced due to vibration is resolved. Moreover, the present invention simplifies the structure of a mold and thus the cost of a mold is reduced.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An improved structure of a terminal, comprising:

a fixing portion having a flat surface, a plurality of tenons formed thereon, an upper end and a lower end;

a pin portion connected to the lower end of said fixing portion, said pin portion being orthogonal to the flat surface of said fixing portion;

a raster spring connected to the upper end of said fixing portion, said raster spring having a flat surface and a protruded upper portion; and a horseshoe-shaped contact portion having a first end connected to a first side of the protruded upper portion of said raster spring, and a second end positioned on a second side of the protruded upper portion, said protruded upper portion protruding between the two ends of said horseshoe-shaped contact portion;

wherein said horseshoe-shaped portion has a smooth outer surface for electrical contact.

* * * * *